US007568529B2

(12) United States Patent
Nonaka et al.

(10) Patent No.: US 7,568,529 B2
(45) Date of Patent: Aug. 4, 2009

(54) DRILL TOOL

(75) Inventors: Takuma Nonaka, Tokyo (JP); Naohide Murakami, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 11/884,925

(22) PCT Filed: Feb. 15, 2006

(86) PCT No.: PCT/JP2006/302658

§ 371 (c)(1),
(2), (4) Date: Aug. 23, 2007

(87) PCT Pub. No.: WO2006/090625

PCT Pub. Date: Aug. 31, 2006

(65) Prior Publication Data

US 2008/0156507 A1 Jul. 3, 2008

(30) Foreign Application Priority Data

Feb. 24, 2005 (JP) ..... 2005-048790

(51) Int. Cl.
*E21B 7/24* (2006.01)

(52) U.S. Cl. ..... 173/49; 173/50; 173/51; 173/104

(58) Field of Classification Search ..... 173/104, 173/201, 162.1, 109, 49–51
See application file for complete search history.

(56) References Cited

U.S. PATENT DOCUMENTS 3,650,336 A * 3/1972 Koehler ..... 173/110
3,685,593 A * 8/1972 Amtsberg et al. ..... 173/14
3,943,782 A * 3/1976 Gloviak ..... 74/50
4,050,527 A * 9/1977 Lebelle ..... 173/49
4,113,034 A * 9/1978 Carlson ..... 173/49
4,585,078 A * 4/1986 Alexandrov et al. ..... 173/93.5
4,601,351 A * 7/1986 Hartwig et al. ..... 173/117
4,719,976 A * 1/1988 Bleicher et al. ..... 173/109
5,355,964 A * 10/1994 White ..... 173/1
5,653,294 A * 8/1997 Thurler ..... 173/48
5,871,059 A * 2/1999 Shibata et al. ..... 173/211
6,073,705 A * 6/2000 Shibata et al. ..... 173/200
6,520,266 B2 * 2/2003 Bongers-Ambrosius et al. .. 173/2
6,658,745 B1 * 12/2003 Huang ..... 30/392
6,739,405 B2 * 5/2004 Plietsch ..... 173/201
6,776,245 B2 * 8/2004 Kristen et al. ..... 173/217

(Continued)

FOREIGN PATENT DOCUMENTS

JP 04-082609 3/1992

(Continued)

*Primary Examiner*—Rinaldi I. Rada
*Assistant Examiner*—Gloria R. Weeks
(74) *Attorney, Agent, or Firm*—Drinker Biddle & Reath LLP

(57) ABSTRACT

A drill tool is provided with: a drive source accommodated in a tool body 2; a bit drive shaft 3 which is rotation-driven by the drive source and provided projectingly from a front end of the drill body 2; and a diamond bit 4 attached to a front end of the bit drive shaft 3. Further, the drill tool is provided with a vibrating apparatus which generates vibrating force which acts in the axial direction of the bit drive shaft 3, a magnitude of which pulsates, and vibrating moment which acts in the rotational direction of the bit drive shaft 3, a magnitude of which pulsates.

4 Claims, 6 Drawing Sheets

U.S. PATENT DOCUMENTS 6,902,012 B2 * 6/2005 Kristen et al. ..... 173/200
7,140,450 B2 * 11/2006 Reed ..... 173/48
7,252,157 B2 * 8/2007 Aoki ..... 173/162.2
7,320,368 B2 * 1/2008 Watanabe ..... 173/48
7,320,369 B2 * 1/2008 Stirm et al. ..... 173/162.2
7,331,407 B2 * 2/2008 Stirm et al. ..... 173/201
7,383,893 B2 * 6/2008 Shimma et al. ..... 173/48

FOREIGN PATENT DOCUMENTS

JP 2003-211436 7/2003
JP 2004-160949 6/2004

* cited by examiner

DRILL TOOL

TECHNICAL FIELD

The present invention relates to a drill tool, and particularly to a concrete drill tool for boring a hole for attaching an anchor or the like to concrete.

BACKGROUND ART

Generally, there are known a hammer drill, a vibration drill, and a diamond drill as the kind of concrete drill tool. A hammer drill or a vibration drill subjects concrete to impact fracture to drill by rotating a nearly solid drill bit attached with an ultra-hard tip at a front end thereof while exerting a striking force or a vibration force in an axial direction. Therefore, though a drilling speed is fast, extremely large noise is emitted in operation by the striking force or the vibration force for subjecting the concrete to the impact fracture. Further, since impact by the striking force and the impulsive force is directly propagated to the concrete, the impact is easily propagated from the concrete at which drill operation is carried out to concrete forming other wall portions or floor portions of a structure. In result, the impact is propagated to a concrete wall and a concrete floor in a room remote from the place at which the drill operation is carried out to emit large noise in a wide range of the structure.

Meanwhile, according to a diamond drill, a front end of a bit in a nearly cylindrical shape or in a nearly columnar shape is attached with a diamond tip in which diamond particles are embedded in a sintered metal referred to as metal bond. By applying pressing force and rotation to the diamond bit, the diamonds of the diamond tip at the front end of the bit bite the concrete, and the concrete is ground, whereby drilling is carried out. The size of a single particle of the diamond of the diamond tip is about 400 micrometers, and a single piece of the bit includes about 1500 particles of the diamond particles. The fine diamond particles cut concrete to drill. Therefore, in the diamond drill, small sound is emitted in drill operation, and the striking force and the impulsive force are not propagated to the concrete not as in the hammer drill and the vibration drill. Therefore, at a room remote from the place at which the drilling operation is carried out even, the sound during drilling operation is considerably low, which makes execution of work possible while people are living in the same structure or at a neighboring house.

In order to accelerate the drilling speed of the diamond drill, it is necessary to increase the concrete cutting amount of the diamond. As means of increasing the concrete cutting amount, there are thought to increase the number of rotations of the diamond bit thereby to increase the cutting amount per time, or to increase the pressing force for pressing the diamond bit, that is, a tool body to a concrete face and to increase the diamond biting amount into the concrete thereby to increase the cutting amount. However, it is important to balance the number of rotations of the diamond bit with the pressing force. In case that the number of rotations of the diamond bit is increased in a state where the pressing force is insufficient, the diamond bit rotates in a state where the front end of the diamond bit cannot bite the concrete sufficiently. In result, the diamond bit wears out early and drilling becomes difficult. Further, the pressing force of the diamond bit (tool) which the operator can keep exhibiting in operation is generally about 10 to 15 Kgf. Accordingly, the operator has a limit in increasing the pressing force of the diamond bit (tool) on the basis of only his bodily powers. In result, even in case that the operator tries to accelerate the drilling speed of the diamond drill, there is a limit. In addition, in case that the operator tries to bore a hole having a larger hole diameter under a condition where there is a limit to the pressing force which the operator can exhibit, as the hole diameter becomes larger, the pressing force per diamond particle decreases. Therefore, it is difficult to accelerate the drilling speed also from the viewpoint.

In order to solve such the problem, in JP-A-2003-211436, a concrete drill has been disclosed, in which a vibrating apparatus for exerting a vibrating force which acts in an axial direction of a bit drive shaft, a magnitude of which pulsates, is provided for a concrete drill apparatus body thereby to accelerate the drilling speed for concrete.

Under constitution of the concrete drill in JP-A-2003-211436, the vibrating force which pulsates along the bit drive shaft is simply exerted. Therefore, from the drilling starting time, the vibrating force is exerted. In result, when drilling starts, the front end of the diamond bit leaps up from the concrete face which is the drilling place due to the vibrating force, and it can become difficult to align the bit front end with the drilling place exactly. Therefore, there is a problem that operability is bad.

DISCLOSURE OF THE INVENTION

In one or more embodiments of the invention, there is provided a drill tool which can accelerate a drilling speed even with small pressing force, can align a bit front end with a drilling place readily, and has good operability.

According to one or more embodiments of the invention, a drill tool is provided with: a drive source accommodated in a tool body, a bit drive shaft which is rotation-driven by the drive source and provided projectingly from a front end of the drill body, a diamond bit attached to a front end of the bit drive shaft, and a vibrating apparatus which generates vibrating force which acts in the axial direction of the bit drive shaft, a magnitude of which pulsates, and vibrating moment which acts in the rotational direction of the bit drive shaft, a magnitude of which pulsates. Hereby, the vibrating force which acts in the axial direction of the bit drive shaft, the magnitude of which pulsates, and the vibrating moment which acts in the rotational direction of the bit drive shaft, the magnitude of which pulsates, are generated on the bit drive shaft.

Further, according to one or more embodiments of the invention, the vibrating apparatus may include two eccentric weights which are arranged on the same axial line orthogonal to an axial line of the bit drive shaft and opposite to each other in substantially symmetrical positions about the axial line of the bit drive shaft, and an eccentric weight drive part which drives the two eccentric weights in rotational directions reverse to each other by means of drive shafts arranged on the same axial line. Hereby, the two eccentric weights which are arranged on the same axial line orthogonal to the axial line of the bit drive shaft and opposite to each other in the nearly symmetrical positions about the axial line of the bit drive shaft are driven in the rotational directions reverse to each other by the eccentric weight drive part composed of the drive shafts arranged on the same axial line.

Preferably, the two eccentric weights are arranged so as to be in the same phase on the front end side and on the back side of the bit drive shaft, and be in the reverse phase in the forward and reverse rotational directions of the bit drive shaft. Hereby, the vibrating force of which a magnitude pulsates along the bit drive shaft, and the vibrating moment of which a magnitude pulsates in the rotational direction of the bit drive shaft can be generated efficiently.

Further, according to one or more embodiments of the invention, the vibrating apparatus may be provided so as to retard a generation of the vibrating force and the vibrating moment after a rotation drive of the bit drive shaft by the drive source. Hereby, the vibrating force and the vibrating moment are retarded to generate after the rotation drive of the bit drive shaft.

Further, according to one or more embodiments of the invention, the vibrating force which acts in the axial direction of the bit drive shaft, the magnitude of which pulsates, and the vibrating moment which acts in the rotational direction of the bit drive shaft, the magnitude of which pulsates, are generated on the bit drive shaft. Therefore, the pressing force of the drill tool can be obtained from the total of the operator's pressing force and the vibrating force, and the operator's pressing force can be compensated by the vibrating force. Further, by exerting the vibrating moment, the magnitude of which pulsates, to the rotational direction of the bit drive shaft, the rotation torque of the bit drive shaft can be obtained from the total of the output of the drive source and the vibrating moment. Therefore, a state where the thus obtained rotational torque is larger than the rotational torque obtained from only the output of the drive source can be obtained. Accordingly, drilling with small pressing force is possible, and the drilling speed can be accelerated. Further, by pulsatively applying the vibrating force to the axial direction of the bit drive shaft and the vibrating moment to the rotational direction thereof, the cut concrete powders are readily exhausted. Therefore, the drill tool is difficult to be affected by the cut concrete powders in drilling, with the result that stable drilling is possible.

Further, when the diamond bit carries out drilling in a state where the pressing force is insufficient, the diamond bit runs idle and the cutting quality lowers, so that it is necessary to recover the cutting quality by maintaining the diamond bit by a sharpening operation. According to one or more embodiments of the invention, by pulsatively applying the vibrating force to the axial direction of the bit drive shaft and the vibrating moment in the rotational direction of the bit drive shaft, drilling can be carried out in a suitable state. Therefore, idle running of the diamond bit can be reduced, so that the maintenance of the diamond bit can be reduced.

Further, according to one or more embodiments of the invention, the two eccentric weights which are arranged on the same axial line orthogonal to the axial line of the bit drive shaft and opposite to each other in the nearly symmetrical positions about the axial line of the bit drive shaft are driven in the rotational directions reverse to each other by the eccentric weight drive part composed of the drive shafts arranged on the same axial line, whereby the vibrating force and the vibrating moment are generated. Therefore, the concrete drill of the invention does not have the mechanism that force by which a bit tool such as a diamond bit can be displaced, such as the striking force by the striking mechanism of the hammer drill or the vibration force by the vibration mechanism of the vibration drill, is applied to the bit tool to subject the concrete to the impact fracture. Therefore, the silent operation in construction is possible.

Further, according to one or more embodiments of the invention, the vibrating force and the vibrating moment are generated late for the rotation drive of the bit drive shaft. Therefore, after drilling has been started with only the rotation of the diamond bit and the drilling position has been secured exactly, the drilling operation with the vibrating force and the vibrating moment is carried out. Therefore, positioning of the diamond bit in the drilling position becomes easy and operability improves.

Other aspects and advantages of the invention will be apparent from the following description and the appended claims.

BRIEF DESCRIPTION OF THE DRAWINGS

FIG. 4(*b*) is a delay control block diagram.

DESCRIPTION OF REFERENCE NUMERALS AND SIGNS

1 Concrete drill
2 Drill body
3 Bit drive shaft
15, 16 Eccentric weights

BEST MODE FOR CARRYING OUT THE INVENTION

Figure 1:
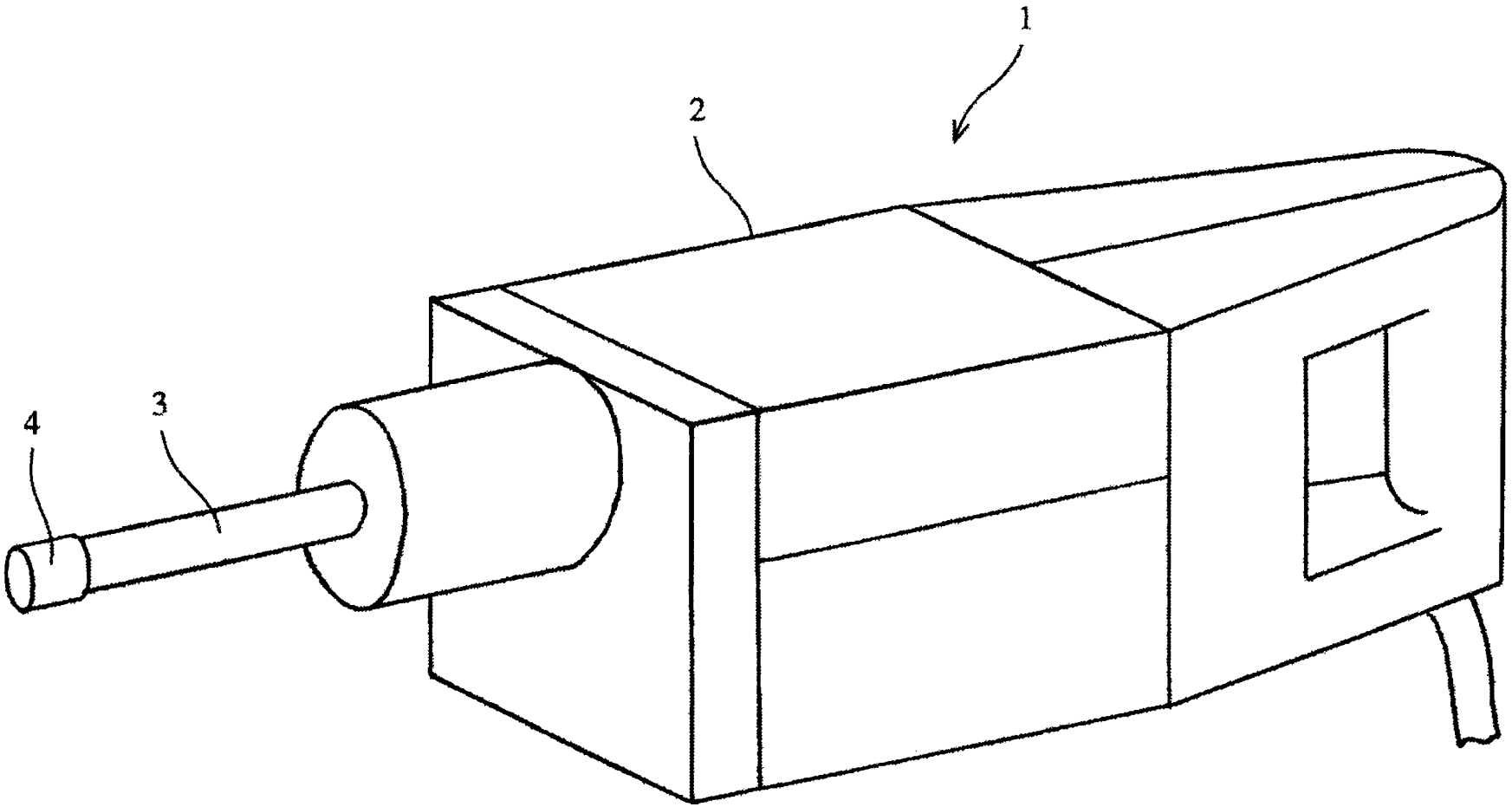
FIG. 1 is a perspective view of a concrete drill.

Referring to drawings, an example of a drill tool according to an embodiment of the invention will be described below. In FIG. 1, numeral 1 designates a concrete drill. The concrete drill 1 drills concrete by driving rotation of a bit drive shaft 3 by means of a drive source contained in a drill body 2, and by rotating a diamond bit 4 attached to a front end of the bit drive shaft 3 projected from a front end of the drill body 2.

Figure 2:
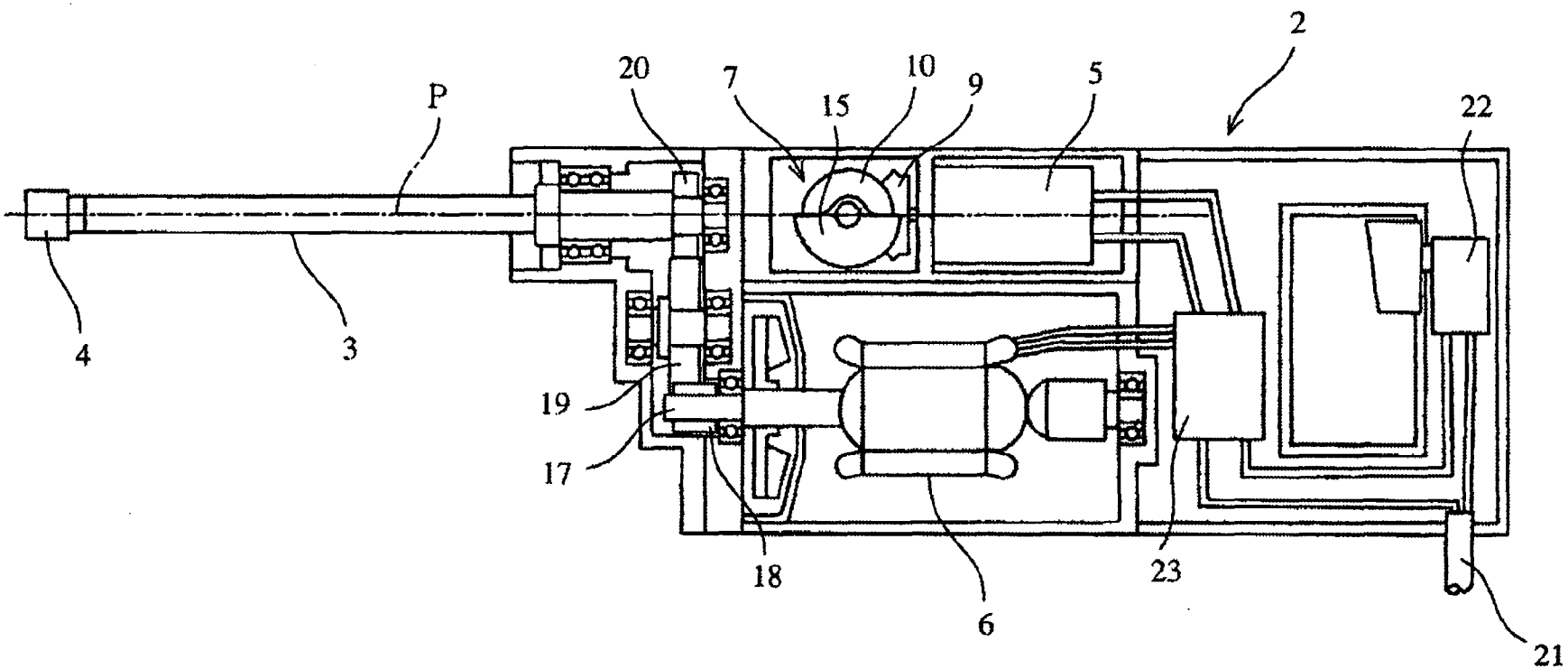
FIG. 2 is a longitudinal sectional view of the above concrete drill.
Figure 3:
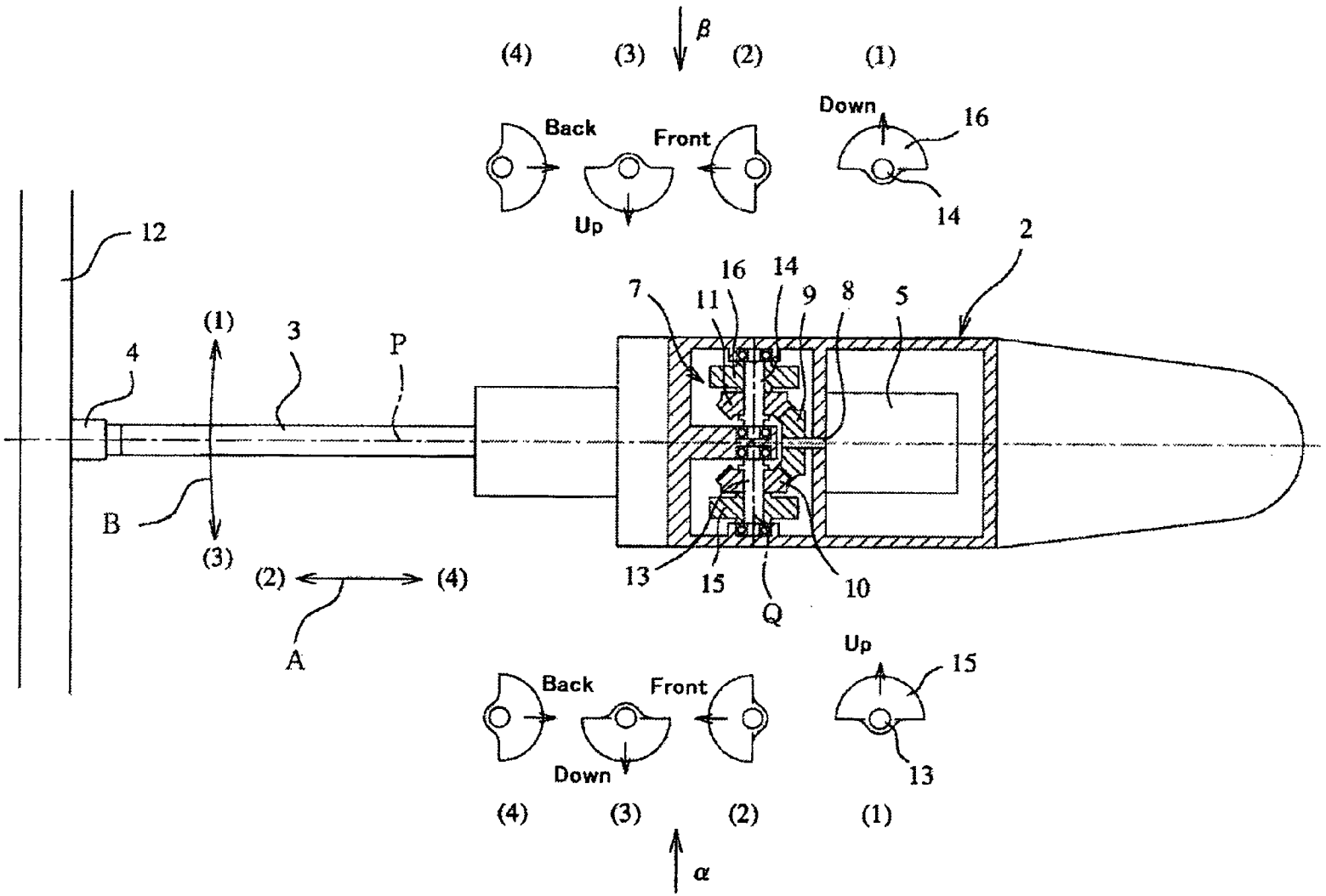
FIG. 3 is a main portion sectional view of a plane of the above concrete drill, and a diagram showing a relation between eccentric weights and forces.

In the drill body 2, as shown in FIG. 2, there are provided a motor 5 for a vibrating apparatus and a motor 6 for a bit drive shaft which are operated as drive sources by electric power. The operation of the vibrating apparatus motor 5 is coupled to a vibrating apparatus 7. Namely, as shown in FIG. 3, a bevel gear 9 (drive bevel gear 9) is fixed to an output shaft 8 of the vibrating apparatus motor 5, and two bevel gears 10, 11 (first driven bevel gear 10, second driven bevel gear 11) which are opposed to each other mesh with the bevel gear 9 on left and right sides of the bevel gear 9. To rotation shafts 13, 14 of the respective bevel gears 10, 11 opposed to each other, eccentric weights 15, 16 are integrally fixed respectively. The eccentric weights 15, 16 are formed semicircularly, and have a shaft hole in the center respectively. The eccentric weights 15, 16 rotate integrally with the bevel gears 10, 11 respectively.

According to the above constitution, when the vibrating apparatus motor 5 is operated, its rotational force is transmitted through the bevel gears 9, 10, and 11 to the eccentric weights 15, 16, and thereafter, the two eccentric weights 15, 16 which are opposed to each other rotate in the reverse direction to each other.

Next, as shown in FIG. 2, the operation of the bit drive shaft motor 6 is coupled to a drive unit. Namely, a gear 18 is formed at an output shaft 17 of the bit drive shaft motor 6, and the gear meshes through a reduction gear 19 located intermediately with a gear 20 of the bit drive shaft 3. The bit drive shaft 3 projects from a front end of the drill body 2. To a front end of the bit drive shaft 3, the diamond bit 4 is attached.

As shown in FIG. 3, the output shaft 8 of the vibrating apparatus motor 5 and the bit drive shaft 3 are located on the same axial line P. Further, the above two eccentric weights 15 and 16 are arranged on the opposite sides to each other centered with respect to the axial line P of the bit drive shaft 3 and on the same axial line Q orthogonal to the axial line P, and they are opposed to each other in positions which are distant equally from an intersection of the axial lines P and Q. Further, the two eccentric weights 15 and 16 are arranged, when the drill body 2 is viewed from an α-side and a β-side, so that when one of them faces in front or in the rear, the other also faces on the same side. Namely, when one 15 of the two eccentric weights faces on one side (front side) in the axial direction of the bit drive shaft 3, the other 16 of the two eccentric weights also faces on one side (front side) in the axial direction of the bit drive shaft 3; and when one 15 of the two eccentric weights faces on the other side (rear side) in the axial direction of the bit drive shaft 3, the other 16 of the two eccentric weights also faces on the other side (rear side) in the axial direction of the bit drive shaft 3.

Figure 4A:
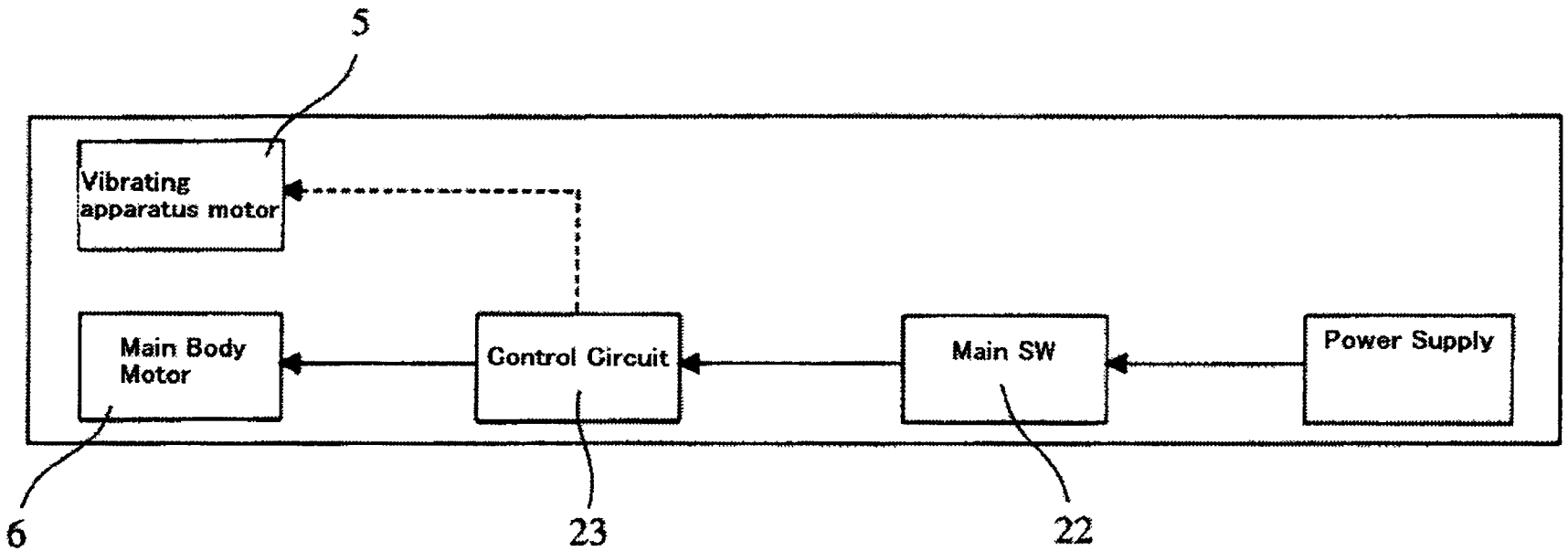
FIG. 4(*a*) is a delay control block diagram.
Figure 4B:
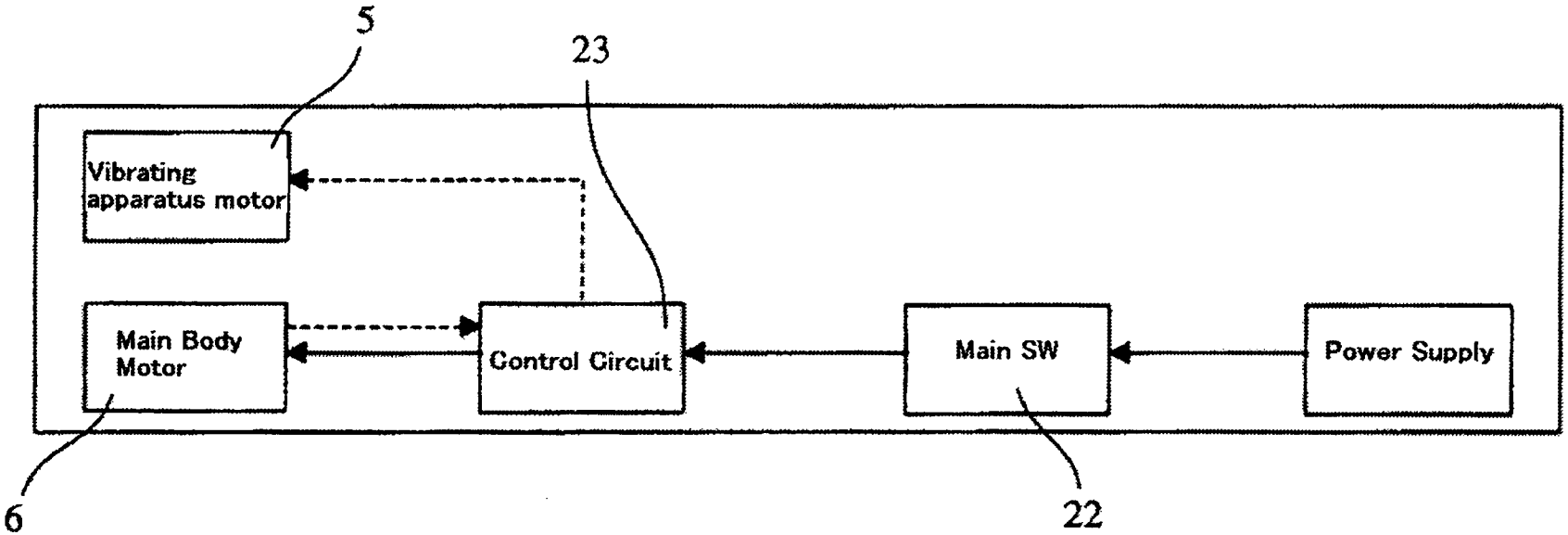

Further, the drill body 2 includes a power code 21, a main switch 22, and a control circuit 23. The control circuit 23 is constituted so that power is supplied to the vibrating apparatus motor 5 later than to the bit drive shaft motor 6. Such the delay control is carried out by delaying the power supply to the vibrating apparatus motor 5 by the control circuit 23 as shown in FIG. 4(*a*), or by perceiving a load of the bit drive shaft motor 6 by the control circuit 23 and thereafter supplying the power to the vibrating apparatus motor 5 as shown in FIG. 4(*b*).

Next, an operation mode of the concrete drill will be described. Firstly, when the main switch 22 is switched on, the bit drive shaft motor 6 operates, and sequentially the vibrating apparatus motor 5 operates.

When the bit drive shaft motor 6 thus operates, the rotation of the output shaft 17 is transmitted through the gears 18, 19 and 20 to the bit drive shaft 3, and the diamond bit 4 located at the front end of the bit drive shaft also rotates. Therefore, the diamond bit 4 is pressed on the concrete, thereby to drill the concrete 12.

Next, the vibrating apparatus motor 5 operates later than the bit drive shaft motor 6. Since the rotation of the output shaft 8 of the motor is transmitted through the bevel gear 9 to the bevel gears 10, 11 opposite to each other, the two eccentric weights 15, 16 opposite to each other rotate simultaneously in the reverse direction to each other.

Since the eccentric weights 15, 16 rotate in the reverse direction to each other, when the phase of one rotation is shifted 90 degrees by 90 degrees, the following forces are applied to the concrete drill as shown in FIG. 3. In (1), the eccentric weight 15 rotates upward and the eccentric weight 16 rotates downward, so that torsion is applied to the drill body 2. In (2), the eccentric weight 15 rotates forward (on the diamond bit 4 side) and the eccentric weight 16 rotates also forward, so that the vibrating force is applied to the drill body 2. In (3), the eccentric weight 15 rotates downward and the eccentric weight 16 rotates upward, so that torsion is applied to the drill body 2. In (4), the eccentric weight 15 rotates backward and the eccentric weight 16 rotates also backward, so that the vibrating force is applied to the drill body 2.

Figure 5:
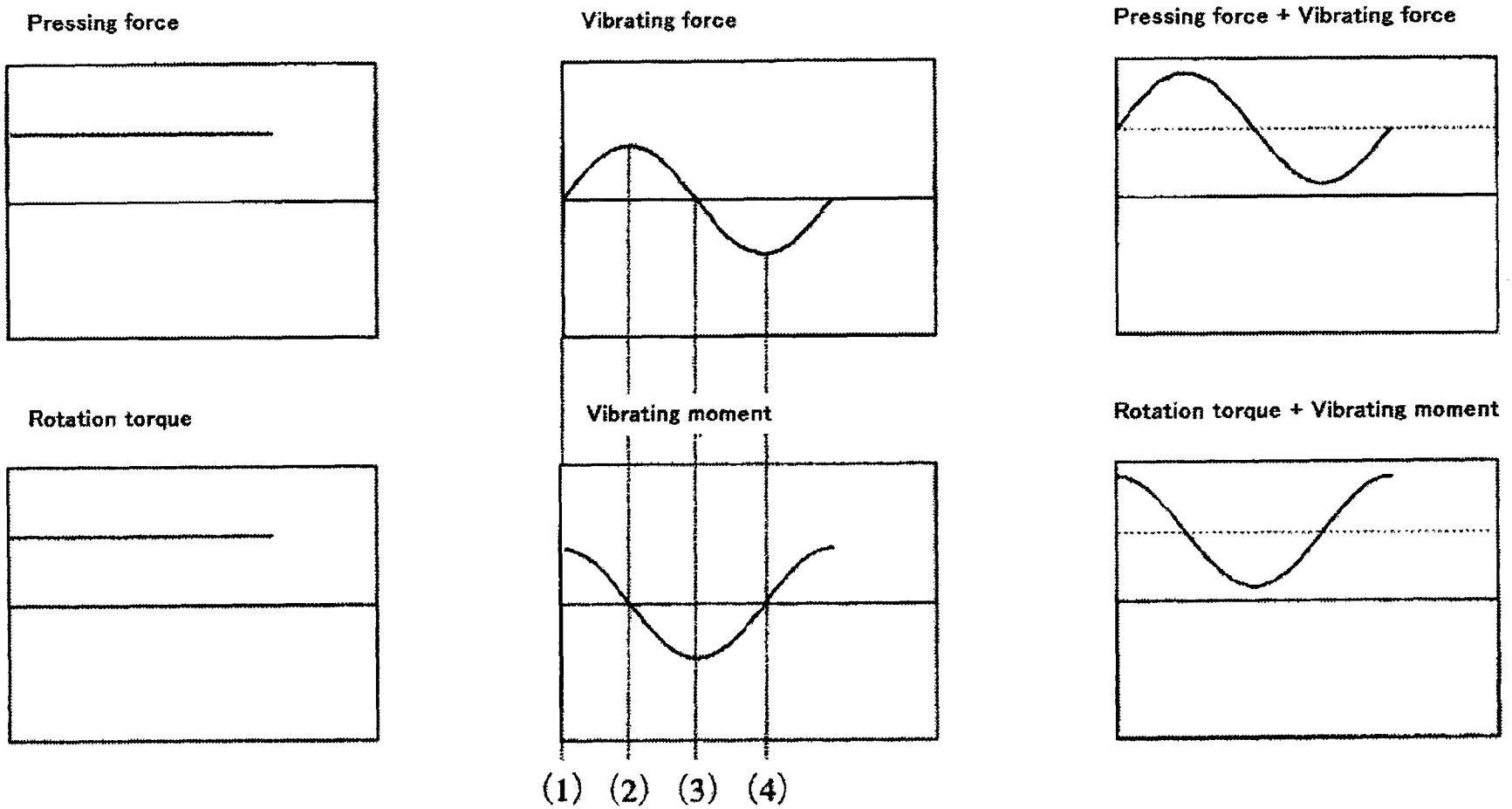
FIG. 5 is a graph showing an advantage obtained by operation of a vibrating apparatus.

Thus, to the concrete drill 1, in the above (2) and (4), the vibrating force of the same phase along the bit drive shaft 3, is applied as shown by an arrow A in FIG. 3, and in the (1) and (3), vibrating moment of the reverse phase on the basis of torsion in the rotational direction of the bit drive shaft 3 is applied as shown by an arrow B in FIG. 3. Each magnitude of the vibrating force and the vibrating moment changes pulsatively in relation to the rotation of the bit drive shaft 3. The above is shown in graphs in FIG. 5.

When the vibrating force and the vibrating moment act in the starting time by operating the bit drive shaft 3 and the vibrating 7 simultaneously, the drill body 2 is vibrated slightly by the vibrating apparatus 7, and the front end of the diamond bit 4 leaps up from the face of the concrete 5, so that positioning of the diamond bit 4 becomes difficult. However, by making power supply to the vibrating apparatus motor 5 later than power supply to the bit drive shaft motor 6, drilling firstly starts to secure the drilling position exactly, and thereafter the vibrating apparatus 7 operates, with the result that positioning becomes easy.

As described above, according to the above concrete drill, the following operational advantages can be obtained. (a) Since the vibrating force which acts in the axial direction of the bit drive shaft 3, a magnitude of which pulsates, and the vibrating moment which acts in the rotational direction of the bit drive shaft, a magnitude of which pulsates, are generated on the bit drive shaft, the pressing force of the drill tool can be obtained from the total of the operator's pressing force and the vibrating force. Therefore, the operator's pressing force can be compensated by the vibrating force. (b) By exerting the vibrating moment, a magnitude of which pulsates, to the rotational direction of the bit drive shaft 3, the rotation torque of the bit drive shaft 3 can be obtained from the total of the output of the drive source and the vibrating moment. Therefore, a state where the thus obtained rotational torque is larger than the rotational torque obtained from only the output of the drive source can be obtained. Accordingly, drilling with small pressing force is possible, and the drilling speed can be accelerated. (c) By pulsatively exerting the vibrating force in the axial direction and the vibrating moment in the rotational direction, the cut concrete powders are readily exhausted. Therefore, the drill tool is difficult to be affected by the cut concrete powders, with the result that stable drilling is possible. (d) When the diamond bit 4 carries out drilling in a state where the pressing force is insufficient, the diamond bit 4 runs idle and the cutting quality lowers, so that it is necessary to recover the cutting quality by maintaining the diamond bit 4 by a grinding operation. However, in the invention, by pulsatively exerting the vibrating force to the axial direction of the bit drive shaft and the vibrating moment in the rotational direction of the bit drive shaft, drilling can be carried out in a suitable state. Therefore, idle running of the diamond bit 4 can be reduced, so that the maintenance of the diamond bit 4 can be reduced. (e) The two eccentric weights 15, 16 which are arranged on the same axial line orthogonal to the axial line of the bit drive shaft 3 and opposite to each other in the nearly symmetrical positions about the axial line of the bit drive shaft 3 are driven in the rotational directions reverse to each other by the eccentric weight drive part composed of the drive shafts arranged on the same axial line, whereby the vibrating force and the vibrating moment are generated. Therefore, the concrete drill of the invention does not have the mechanism that force by which a bit tool such as a diamond bit can be displaced, such as the striking force by the striking mechanism of the hammer drill and the vibration force by the vibration mechanism of the vibration drill, is applied to the bit tool to subject the concrete to the impact fracture. Therefore, the silent operation in construction is possible. (f) By making a start of the eccentric weights 15, 16 later than a start of the bit drive shaft 3, the vibrating force and the vibrating moment are generated late for the drive of the rotation of the bit drive shaft 3. Therefore, after drilling operation has been started with only the rotation of the diamond bit and the drilling position has been secured exactly, the drilling operation with the vibrating force and the vibrating moment are carried out, so that positioning of the diamond bit 4 in the drilling position becomes easy and operability improves.

Actually, when the concrete drill mounted with the vibrating apparatus of the invention was executed, it was confirmed that the drilling speed was accelerated by about 20%, compared with the concrete drill mounted with the conventional vibrating apparatus.

The eccentric amounts of the eccentric weights 15, 16 may be determined on the basis of the vibrating force. The vibrating moment may be adjusted by changing the distance of the eccentric weights 15, 16 from the intersection of the axial lines P and Q.

Though the concrete drill using the substantially solid diamond bit have been described in the above embodiment, the invention may be applied to a concrete drill using a substantially hollow diamond bit referred to as a core drill.

Although the invention has been described in detail and with reference to a specified embodiment, it will be obvious to those skilled in the art that various changes and modification may be made without departing from the spirit and scope of the invention.

The application is based on Japanese Patent Application (No. 2005-048790) filed on Feb. 24, 2005, the contents of which are herein incorporated by reference.

INDUSTRIAL APPLICABILITY

According to the embodiment of the invention, there is provided a concrete drill which can accelerate more a drilling speed even with small pressing force.

The invention claimed is:

1. A drill tool comprising:

a drive source accommodated in a tool body;

a bit drive shaft rotation-driven by the drive source and projecting from a front end of the drill body;

a diamond bit attached to a front end of the bit drive shaft; and a vibrating apparatus configured to generate vibrating force in an axial direction of the bit drive shaft and vibrating moment in a rotational direction of the bit drive shaft, wherein a magnitude of the vibrating force pulsates and a magnitude of the vibrating moment pulsates, wherein the vibrating apparatus comprises:

two eccentric weights arranged on the same axial line orthogonal to an axial line of the bit drive shaft and opposite to each other in substantially symmetrical positions about the axial line of the bit drive shaft;

a vibrating apparatus motor configured to drive the two eccentric weights in rotational directions reverse to each other; and an output shaft of the vibrating apparatus motor is arranged on the same axial line as the axial line of the bit drive shaft.

2. The drill tool according to claim 1, wherein the vibrating apparatus retards to generate the vibrating force and the vibrating moment after a rotation drive of the bit drive shaft by the drive source.

3. The drill tool according to claim 1, further comprising:

a drive bevel gear provided on the output shaft of the vibrating apparatus motor; and first and second driven bevel gears which mesh with the drive bevel gear, wherein one of the two eccentric weights is fixed to a rotational shaft of the first driven gear, and the other of the two eccentric weights is fixed to a rotational shaft of the second driven gear.

4. The drill tool according to claim 1, when one of the two eccentric weights faces on one side in the axial direction of the bit drive shaft, the other of the two eccentric weights also faces on the one side in the axial direction of the bit drive shaft; and when one of the two eccentric weights faces on the other side in the axial direction of the bit drive shaft, the other of the two eccentric weights also faces on the other side in the axial direction of the bit drive shaft.

* * * * *